US010502428B2

(12) United States Patent
Lim et al.

(10) Patent No.: US 10,502,428 B2
(45) Date of Patent: Dec. 10, 2019

(54) COOKING APPLIANCE AND GAS BURNER

(71) Applicant: LG ELECTRONICS INC., Seoul (KR)

(72) Inventors: Jaebeom Lim, Seoul (KR); Yongki Jeong, Seoul (KR); Janghee Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 663 days.

(21) Appl. No.: 14/865,623

(22) Filed: Sep. 25, 2015

(65) Prior Publication Data

US 2016/0201920 A1 Jul. 14, 2016

(30) Foreign Application Priority Data

Jan. 13, 2015 (KR) ..... 10-2015-0005512

(51) Int. Cl.

| | |
|---|---|
| ***F24C 3/08*** | (2006.01) |
| ***F23D 14/04*** | (2006.01) |
| ***F23D 14/06*** | (2006.01) |
| ***F23D 14/08*** | (2006.01) |

(52) U.S. Cl.

CPC ..... *F24C 3/082* (2013.01); *F23D 14/04* (2013.01); *F23D 14/065* (2013.01); *F23D 14/085* (2013.01); *F24C 3/085* (2013.01)

(58) Field of Classification Search

CPC ..... F23D 14/065; F23D 14/085; F24C 3/085; F24C 3/082

USPC ..... 126/39 E; 431/181, 354

See application file for complete search history.

(56) References Cited

U.S. PATENT DOCUMENTS

| | | | | |
|---|---|---|---|---|
| 6,209,534 | B1 * | 4/2001 | Taplan | F23D 14/06 126/214 A |
| 2005/0026098 | A1 * | 2/2005 | Molla | F24C 3/085 431/181 |
| 2012/0266862 | A1 | 10/2012 | Ryu et al. | |

FOREIGN PATENT DOCUMENTS

| | | | | |
|---|---|---|---|---|
| DE | 198 13 691 | C1 | 6/1999 | |
| EP | 0095053 | A1 * | 11/1983 | F23D 14/065 |
| EP | 1 503 146 | A1 | 2/2005 | |
| EP | 1 666 793 | A1 | 6/2006 | |
| GB | 2 256 268 | A | 12/1992 | |
| WO | 00/40900 | A1 | 7/2000 | |
| WO | 2006/046922 | A1 | 5/2006 | |

* cited by examiner

*Primary Examiner* — Avinash A Savani
*Assistant Examiner* — Aaron H Heyamoto
(74) *Attorney, Agent, or Firm* — Dentons US LLP

(57) ABSTRACT

A gas burner including a frame having an upper plate; a burner head seated on the upper plate and having a mixed gas flowing part; a burner cap seated on the burner head; and a burner body at which a nozzle configured to inject a gas to the burner head is installed, wherein the nozzle is disposed at an outside of the frame.

18 Claims, 7 Drawing Sheets

COOKING APPLIANCE AND GAS BURNER

CROSS-REFERENCE TO RELATED APPLICATION(S)

This application claims priority under 35 U.S.C. § 119 to Korean Application No. 10-2015-0005512, filed in Korea on Jan. 13, 2015, whose entire disclosure is hereby incorporated by reference.

BACKGROUND

1. Field

A cooking appliance and a gas burner are disclosed herein.

2. Background

A cooking appliance is an apparatus which cooks food using heat of a heating source. As an example of a cooking appliance, an oven range includes an oven chamber in which the food is cooked, and a burner in which a gas is burnt to cook the food in the oven chamber.

Korean Patent No. 0516667 (registered on Aug. 29, 2005) discloses a sealed burner installation structure of a gas oven range.

The above-described related document discloses an upper plate which forms an upper case of a top burner part of the gas oven range, a burner body which is inserted into and installed at the top burner part, a burner head which is installed at an upper side of the burner body and located at an upper side of the upper plate, and a burner cap which covers an upper side of the burner head.

A hole through which the burner body passes is formed at the upper plate. A nozzle is provided at the burner body, and the gas injected from the nozzle may flow through an internal space of the burner body, and then may be introduced into the burner head.

According to the above-described related document, in a state in which the nozzle installed at the burner body is located lower than the upper plate, the gas injected from the nozzle flows up, passes through the upper plate, and then is introduced into the burner head.

Therefore, since a space for installing the nozzle and a space for allowing the gas injected from the nozzle to flow up are required in the burner body, a longitudinal height of the burner body should be ensured at a predetermined height, and thus there is a problem in that a height of the top burner part is increased.

Also, when the burner head is separated from the burner body to clean the burner head and the burner cap, the hole formed at the upper plate is exposed to an outside, and thus it is difficult to clean the upper plate, and also water or a foreign substance may be introduced through the hole, while the upper plate is cleaned.

SUMMARY

The present disclosure is directed to a gas burner which is capable of reducing a height thereof, and a cooking appliance having the same.

Also, the present disclosure is directed to a gas burner having enhanced cleanability of an upper plate on which a burner head is seated, and a cooking appliance.

According to an aspect of the present disclosure, there is provided a gas burner including a frame having an upper plate; a burner head seated on the upper plate and having a mixed gas flowing part; a burner cap seated on the burner head; and a burner body at which a nozzle configured to inject a gas to the burner head is installed, wherein the nozzle is disposed at an outside of the frame.

According to another aspect of the present disclosure, there is provided a cooking appliance including a gas burner configured to cook food using a flame; and an oven unit disposed at a lower side of the gas burner and having a cooking chamber configured to accommodate the food, wherein the gas burner includes a frame having an upper plate, a burner head seated on the upper plate, a burner cap seated on the burner head and having a plurality of mixed gas discharging holes configured to generate the flame, a nozzle configured to inject a gas to the burner head and located higher than the upper plate, and a burner body configured to support the nozzle.

According to still another aspect of the present disclosure, there is provided a gas burner including a frame having an upper plate; a burner head seated on the upper plate and having a mixed gas flowing part; a burner cap seated on the burner head and having a plurality of mixed gas discharging holes configured to generate a flame; and a burner body at which a nozzle configured to inject a gas to the burner head is installed, wherein the nozzle injects horizontally the gas toward the mixed gas flowing part.

The details of one or more embodiments are set forth in the accompanying drawings and the description below. Other features will be apparent from the description and drawings, and from the claims.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
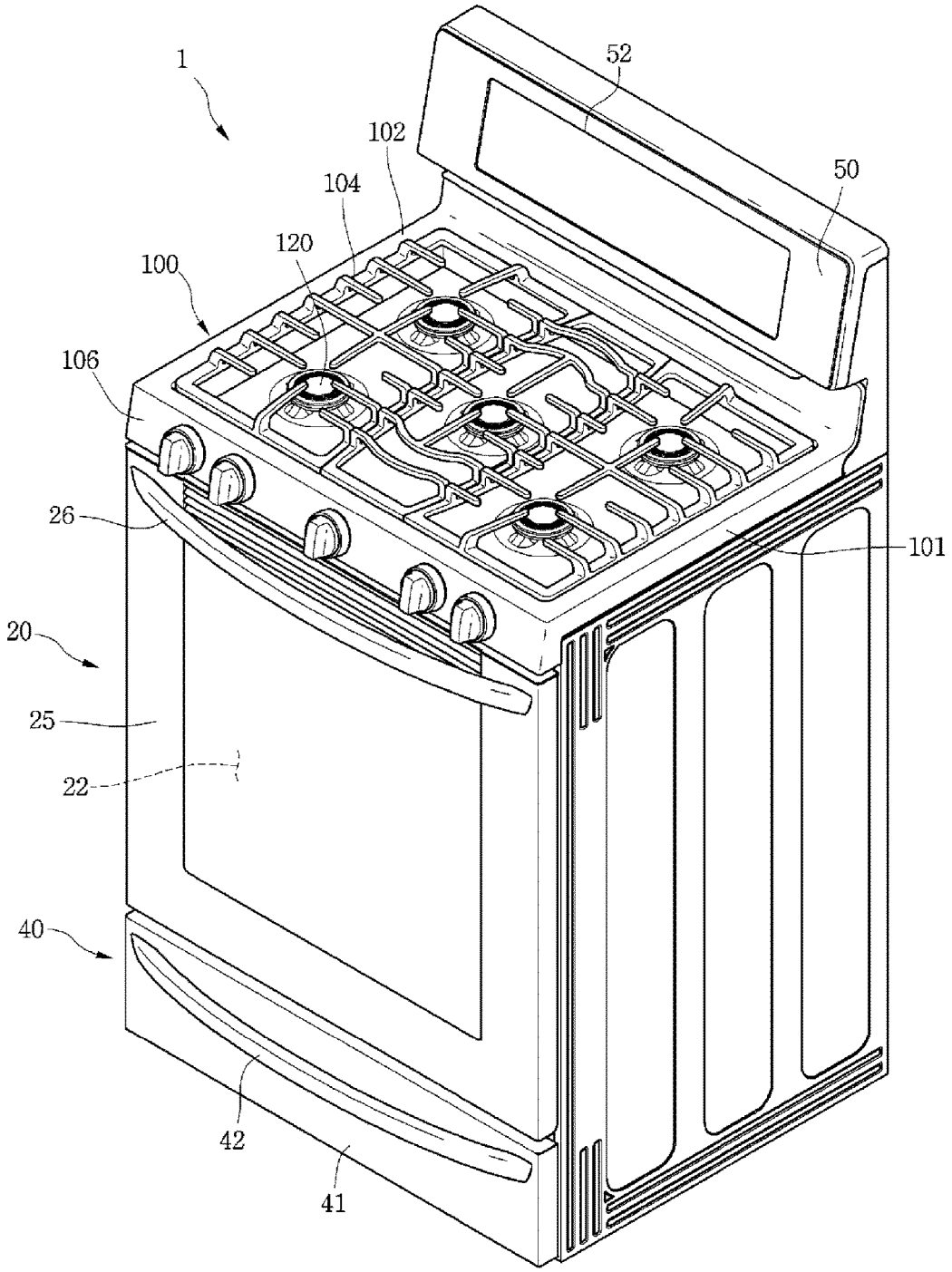
FIG. 1 is a perspective view of a cooking appliance according to an embodiment.

FIG. 1 is a perspective view of a cooking appliance according to an embodiment.

Referring to FIG. 1, the cooking appliance 1 according to an embodiment may include a cook-top unit having a gas burner 100.

Also, the cooking appliance 1 may further includes one or more of an oven unit 20, a drawer unit 40 and a control panel 50.

Also, according to a kind of the cooking appliance 1, the cooking appliance 1 may include a plurality of oven units 20.

The gas burner 100, the oven unit 20 and the drawer unit 40 may be provided at an upper portion, a center portion and a lower portion of the cooking appliance 1, respectively. And the control panel 50 may be provided at a rear end of an upper surface of the cooking appliance 1.

The gas burner 100 may include a frame 101 which forms an exterior. The gas burner 100 may include a plurality of burner sets 120.

Each of the burner sets 120 may cook food by directly heating the food or a container filled with the food using a flame generated when burning a gas.

A part of each of the burner sets 120 may be located at an outside of the frame 101, and another part thereof may be located at an inside of the frame 101.

The gas burner 100 may further include a plurality of container supporting parts 104 which support the container accommodating the food. The container supporting parts 104 may be seated on an upper plate 102 of the frame 101.

An operation part 106 for operating the plurality of burner sets 120 may be disposed at a front end of the gas burner 100.

The oven unit 20 may include a cooking chamber 22 in which the food is accommodated, and a door 25 which opens and closes the cooking chamber 22. The door 25 may be pivotably connected to the cooking appliance 1. For example, the door 25 opens and closes the cooking chamber 22 in a pull-down manner in which an upper end thereof is pivoted up and down about a lower end thereof. However, in the embodiment, an operation method of the door 25 is not limited.

A door handle 26 which is grasped by a user's hand may be provided at an upper end of a front surface of the door 25 to pivot the door 25.

The drawer unit 40 serves to maintain the container filled with the food at a predetermined temperature. The drawer unit 40 may include a drawer 41 in which the container is received. The drawer 41 may be slidingly put into or withdrawn from the cooking appliance 1. A handle 42 which is grasped by a user may be provided at a front surface of the drawer 41.

The control panel 50 may include a user interface 52 which receives an input of an operating signal for operating the cooking appliance 1, specifically, an operating signal for operating at least one of the oven unit 20 and the drawer unit 40. The user interface 52 may display various types of information on an operation of the cooking appliance 1 to an outside.

Figure 2:
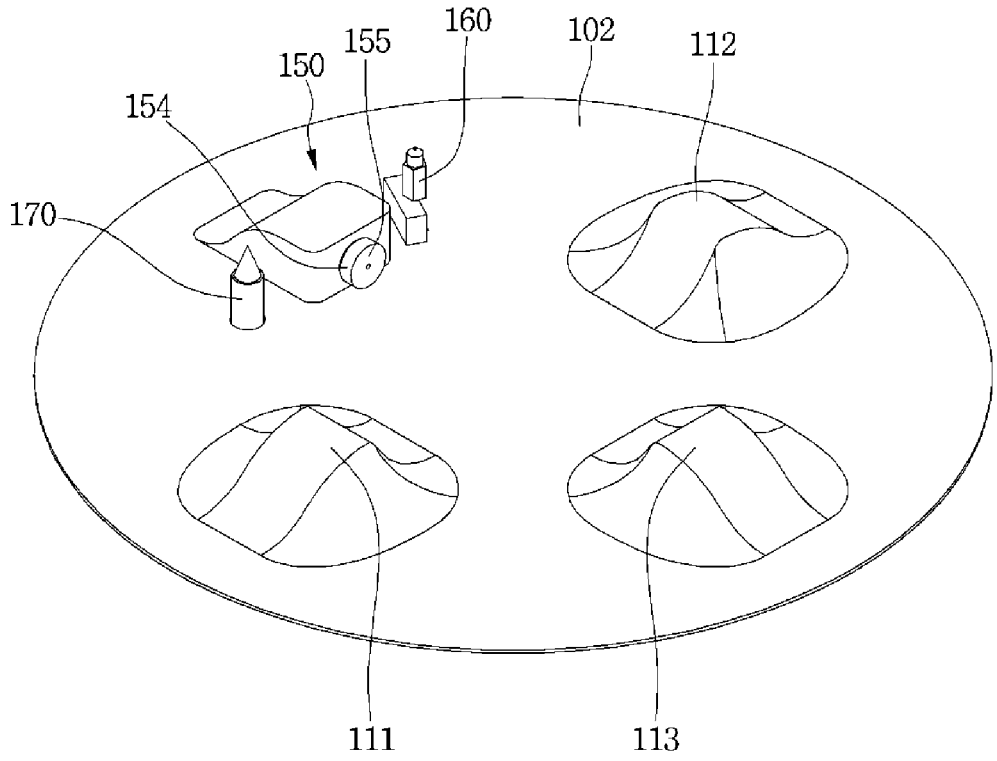
FIG. 2 is a view illustrating an upper plate of a gas burner on which a burner assembly is seated.
Figure 3:
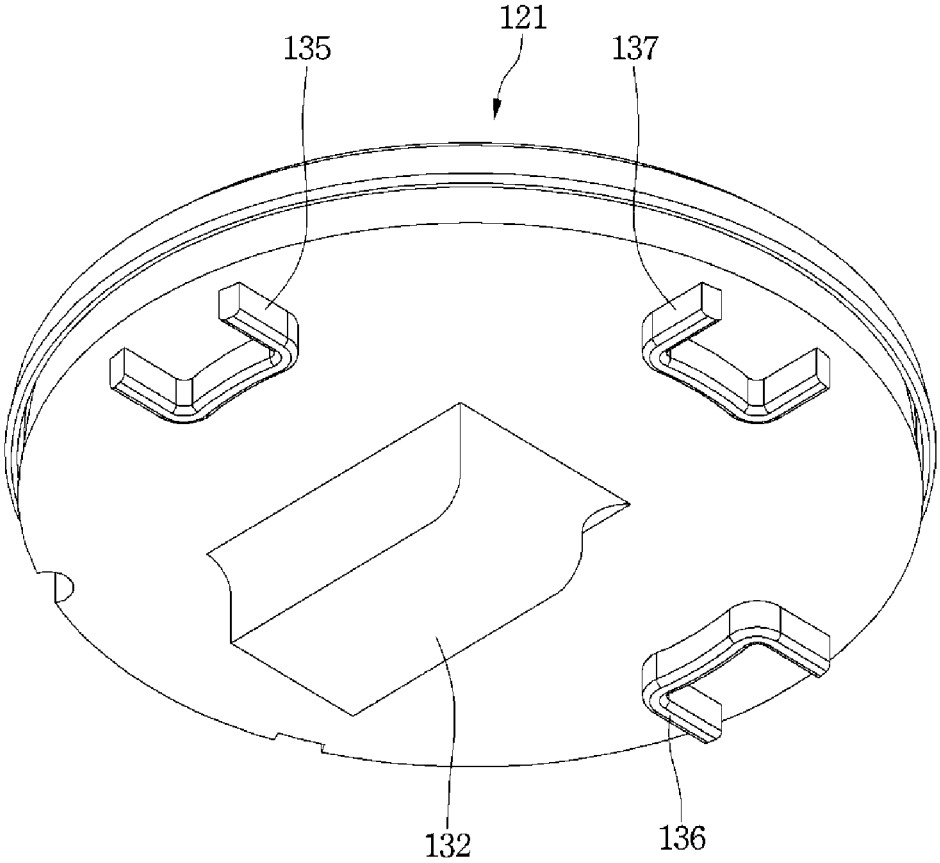
FIG. 3 is a perspective view illustrating a lower side of the burner assembly.
Figure 4:
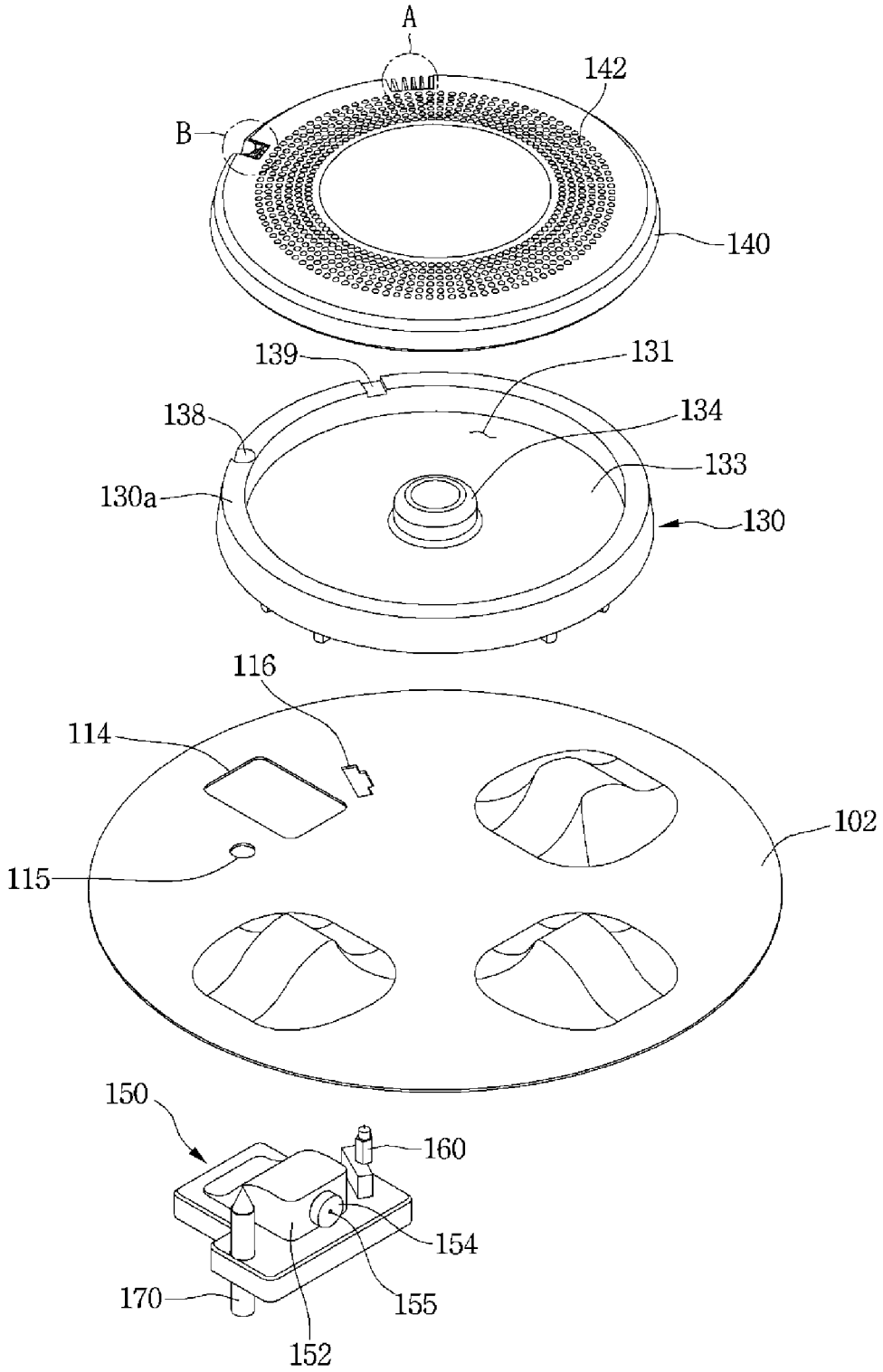
FIG. 4 is an exploded perspective view of a burner set according to an embodiment.

FIG. 2 is a view illustrating the upper plate of the gas burner on which a burner assembly is seated, FIG. 3 is a perspective view illustrating a lower side of the burner assembly, and FIG. 4 is an exploded perspective view of the burner set according to an embodiment.

Referring to FIGS. 1 to 4, the burner set 120 according to the embodiment may include a burner assembly 121 and a burner body (which may be referred to as a "nozzle assembly") 150.

The burner assembly 121 may include a burner head 130 and the burner cap 140.

The burner head 130 may be seated on the upper plate 102 of the frame 101. One or more supporting parts 111, 112 and 113 for supporting the burner head 130 may be provided at the upper plate 102 of the frame 101.

The one or more supporting parts 111, 112 and 113 may protrude upward from an upper surface of the upper plate 102. For example, the one or more supporting parts 111, 112 and 113 may be formed by pressing a part of the upper plate 102 upward.

To stably support the burner head 130, a plurality of supporting parts 111, 112 and 113 may be provided at the upper plate 102. FIG. 3 illustrates an example in which three supporting parts are provided at the upper plate 102. However, in the embodiment, the number of the supporting parts is not limited.

To allow the upper plate 102 to be easily cleaned when the upper plate 102 having the supporting parts 111, 112 and 113 is cleaned, the supporting parts 111, 112 and 113 may be formed so that horizontal cross sectional areas thereof are gradually reduced toward upper sides thereof. Also, each of the supporting parts 111, 112 and 113 may include a rounded surface.

Therefore, the user may easily clean the upper plate 102 having the supporting parts 111, 112 and 113.

To prevent the burner head 130 from being horizontally moved or rotated while the burner head 130 is seated on the supporting parts 111, 112 and 113, one or more movement preventing parts 135, 136 and 137 which are in contact with the one or more supporting parts 111, 112 and 113 may be provided at the burner head 130.

The one or more movement preventing parts 135, 136 and 137 may protrude downward from a lower surface of the burner head 130.

The one or more movement preventing parts 135, 136 and 137 may be bent once or more times, and thus may be in contact with the one or more supporting parts 111, 112 and 113 at least two or more points. The one or more movement preventing parts 135, 136 and 137 may surround the one or more supporting parts 111, 112 and 113.

A plurality of movement preventing parts 135, 136 and 137 may be provided at the burner head 130. In this case, the number of the movement preventing parts 135, 136 and 137 may be the same as that of the supporting parts 111, 112 and 113. Alternatively, the number of the movement preventing parts 135, 136 and 137 may be smaller than that of the supporting parts 111, 112 and 113.

When the plurality of movement preventing parts 135, 136 and 137 are provided at the burner head 130, at least a part of each of two movement preventing parts may be located between two supporting parts.

For example, a part of a first movement preventing part 135 and a part of a second movement preventing part 136 may be located between first and second supporting parts 111 and 112.

One or more of the plurality of movement preventing parts 135, 136 and 137 may be bent two or more times. The horizontal cross sectional areas of one or more of the plurality of movement preventing parts 135, 136 and 137 may have a "U" shape, but the present disclosure is not limited thereto.

The burner head 130 may include a mixed gas chamber 131 in which a mixed gas is received.

Also, the burner head 130 may include a mixed gas flowing part 132 in which the mixed gas of air and gas flows. The mixed gas flowing part 132 may be integrally formed with the lower surface of the burner head 130, or may be coupled to the lower surface of the burner head 130.

A part of the mixed gas flowing part 132 may be located at a center portion of the burner head 130, and the mixed gas flowing part 132 may radially extend from the center portion of the burner head 130. One end of the mixed gas flowing part 132 is opened.

That is, the mixed gas flowing part 132 may horizontally extend from the lower surface of the burner head 130.

The burner head 130 may further include a guide part 134 which guides the mixed gas flowing through the mixed gas flowing part 132 upward (toward the burner head). The guide part 134 may protrude upward from a bottom wall 133 forming the mixed gas chamber 131. Therefore, the guide part 134 may guide an upward flow of the mixed gas flowing through the mixed gas flowing part 132.

The burner body 150 may include a nozzle installation part 152 in which a nozzle 154 for injecting the gas is installed. The nozzle 154 may be horizontally installed at the nozzle installation part 152.

A through-hole 114 through which the nozzle installation part 152 passes may be formed at the upper plate 102.

The nozzle installation part 152 may pass through the through-hole 114 from a lower side of the upper plate 102.

Therefore, while the burner body 150 is installed at the upper plate 102, the nozzle installation part 152 and the nozzle 154 protrude upward from the upper surface of the upper plate 102. A part of the burner body 150 blocks the through-hole 114.

An injection hole 155 through which the gas is injected from the nozzle 154 is located higher than the upper surface of the upper plate 102. Of course, the nozzle 154 may also be located higher than the upper surface of the upper plate 102.

Therefore, according to the embodiment, since the injection hole 155 of the nozzle 154 is located higher than the upper surface of the upper plate 102, slops or the like may be prevented from being introduced into the injection hole 155 in the process of cooking the food using the burner set 120. Also, foreign substances may also be prevented from being introduced into the injection hole 155 in the process of cleaning the upper plate 102.

Also, according to the embodiment, since the nozzle 154 is located higher than the upper surface of the upper plate 102, and the burner body 150 blocks the through-hole 114 through which the nozzle 154 passes, the foreign substances may be prevented from being introduced into an inside of the frame 101 of the gas burner 100 through the through-hole 114.

The nozzle 154 may be disposed to be spaced horizontally from the mixed gas flowing part 132.

The injection hole 155 of the nozzle 154 may be disposed to face an entrance of the mixed gas flowing part 132 of the burner head 130. Since the nozzle 154 is located above the upper plate 102, the entire mixed gas flowing part 132 of the burner head 130 may be located at the outside of the frame 101.

The burner set 120 may further include an ignition part 160 which ignites the mixed gas supplied to the burner assembly 121, and a flame detection part 170 which detects whether the flame is generated at the burner assembly 121.

One or more of the ignition part 160 and the flame detection part 170 may be installed at the burner body 150. FIG. 4 illustrates an example in which the ignition part 160 and the flame detection part 170 are installed at the burner body 150.

The upper plate 102 may have a first hole 115 through which the flame detection part 170 passes, and a second hole 116 through which the ignition part 160 passes.

Meanwhile, the burner head 130 may include a chamber forming wall 130*a* which forms the mixed gas chamber 131.

A receiving recess 138 in which at least a part of the flame detection part 170 is received may be formed at the chamber forming wall 130*a*.

Also, the chamber forming wall 130*a* may have a mixed gas guide hole 139 through the mixed gas in the mixed gas chamber 131 passes.

The mixed gas passing through the mixed gas guide hole 139 may flow toward the ignition part 160. Therefore, the mixed gas guide hole 139 may be located adjacent to the ignition part 160.

The burner cap 140 may be seated on the burner head 130, and may cover the mixed gas chamber 131 of the burner head 130.

The burner cap 140 may include a plurality of mixed gas discharging holes 142 through which the mixed gas is discharged. While the mixed gas is discharged from the plurality of mixed gas discharging holes 142, the flame is generated. That is, the plurality of mixed gas discharging holes 142 may be referred to as flame holes.

The plurality of mixed gas discharging holes 142 may be disposed in a ring shape when seen from an upper surface of the burner body 150. At this time, the plurality of mixed gas discharging holes 142 may be disposed to have a plurality of rows in a radial direction of the burner cap 140.

And the plurality of mixed gas discharging holes 142 may be disposed to be spaced from each other at regular intervals from an edge of the burner cap 140 toward a center portion thereof.

Figure 5:
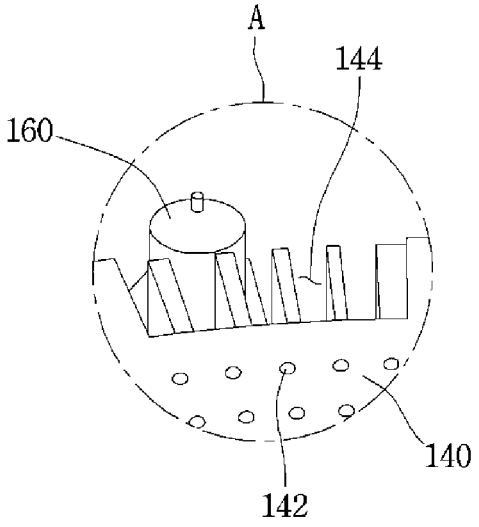
FIG. 5 is an enlarged view of a portion A of FIG. 4.

FIG. 5 is an enlarged view of a portion A of FIG. 4.

Referring to FIG. 5, one or more first slits 144 may be provided at the edge of the burner cap 140. The first slits 144 may spread the flame. That is, the mixed gas discharged through the mixed gas guide hole 139 formed at the chamber forming wall 130*a* of the burner head 130 is ignited by the ignition part 160, and thus the flame is generated, and the generated flame may be spread to one or more mixed gas discharging holes 142 by the first slits 144.

Figure 6:
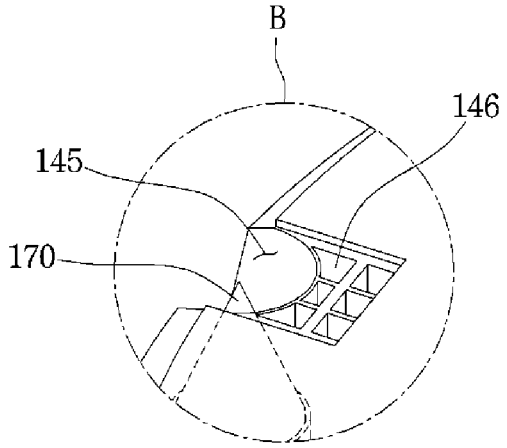
FIG. 6 is an enlarged view of a portion B of FIG. 4.

FIG. 6 is an enlarged view of a portion B of FIG. 4.

Referring to FIG. 6, a receiving recess 145 in which at least a part of the flame detection part 170 may be located may be provided at the edge of the burner cap 140. And one or more second slits 146 may be provided at a position which is spaced from the burner cap 140 toward an inside of the receiving recess 145. The second slits 146 serves to allow the flame to be stayed therein. The second slits 146 may be disposed between one of the plurality of mixed gas discharging holes 142 and the flame detection part 170.

When the flame stays in the second slits 146, the flame detection part 170 may detect the flame in the second slits 146. When the flame is not detected by the flame detection part 170, a gas supply to the burner body 150 may be cut off. That is, a gas injection of the nozzle 54 may be prevented.

Figure 7:
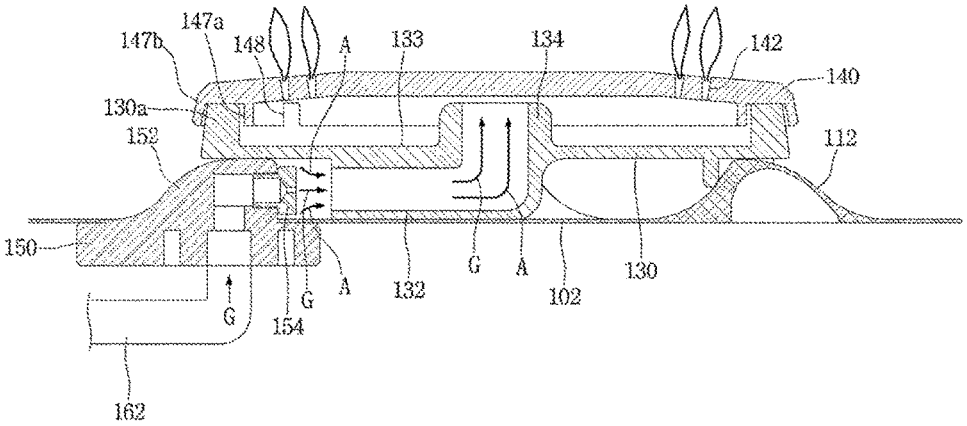
FIG. 7 is a vertical cross-sectional view of the gas burner according to an embodiment.

FIG. 7 is a vertical cross-sectional view of the gas burner according to the embodiment.

Referring to FIGS. 1 to 7, a part of the burner body 150 may pass through the upper plate 102, and then may be located at the outside of the frame 101, and another part of the burner body 150 may be located at the inside of the frame 101.

The nozzle installation part 152 and the nozzle 154 are located at the outside of the frame 101.

According to the embodiment, in the burner body 150, since the nozzle installation part 152 and the nozzle 154 are located at the outside of the frame 101, a height (hereinafter referred to as an "internal height of the burner body") of the burner body 150 located at the inside of the frame 101 may be minimized.

A gas supply pipe 162 may be connected to the burner body 150. Even when a height of the gas supply pipe 162 is considered, the internal height of the burner body of the embodiment may be lower than that of the burner body when the nozzle is located at the inside of the frame.

Therefore, according to the embodiment, an entire height of the gas burner may be reduced.

The height of the gas burner is associated with a volume of the cooking chamber of the oven unit located at a lower side of the gas burner.

Since an entire height of the cooking appliance is limited, a height of the cooking chamber of the oven unit should be reduced, when the height of the gas burner is increased. When the height of the cooking chamber of the oven unit is reduced, the volume of the cooking chamber is reduced.

However, according to the embodiment, since the height of the gas burner is reduced, the height of the cooking chamber of the oven unit may be increased, and thus the volume of the cooking chamber may also be increased.

The mixed gas flowing part 132 of the burner head 130 may be seated on the upper plate 102 of the frame 101. Also, the burner head 130 may be seated on the nozzle installation part 152 of the burner body 150.

The burner cap 140 may further include an inner wall 147*a* which is located at the mixed gas chamber 131, and an outer wall 148*a* which is located at an outside of the chamber forming wall 130*a* of the burner head 130.

The inner wall 147*a* may extend downward from the lower surface of the burner cap 140. And a lower end of the inner wall 147*a* may be spaced from the bottom wall 133 of the mixed gas chamber 131.

A hole 148 through which the mixed gas passes may be formed at the inner wall 147*a*. The hole 148 may be disposed to face the mixed gas guide hole 139 of the burner head 130.

Due to the outer wall 147*b* and the inner wall 147*a* of the burner cap, the burner cap 140 may be prevented from being easily separated from the burner head 130.

As another example, one of the outer wall 147*b* and the inner wall 147*a* may be omitted from the burner cap 140.

Hereinafter, an operation of the gas burner will be described.

The gas G may be supplied to the burner body 150 through the gas supply pipe 162. The gas G supplied to the burner body 150 may be injected through the injection hole 155 of the nozzle 154.

The gas G may be horizontally injected from the nozzle 154. The gas G injected from the nozzle 154 may be introduced into the mixed gas flowing part 132.

At this time, since the nozzle 154 is spaced from the entrance of the mixed gas flowing part 132, air A near the mixed gas flowing part 132 may be introduced into the mixed gas flowing part 132 in the process in which the gas G injected from the nozzle 154 is introduced into the mixed gas flowing part 132.

The air A and the gas G introduced into the mixed gas flowing part 132 may flow horizontally and then flow vertically. The air and the gas may be mixed while they flow along the mixed gas flowing part 132.

The mixed gas may flow along the guide part 134 toward a lower surface of a center portion of the burner cap 140. As the mixed gas flows along the guide part 134 toward the lower surface of the center portion of the burner cap 140, it may be minimized that the mixed gas discharged from the guide part 134 and introduced into the mixed gas chamber 131 is concentrated on some of the plurality of mixed gas discharging holes 142 of the burner cap 140.

Some of the mixed gas introduced into the mixed gas chamber 131 passes through the hole 148 of the inner wall 147*a* of the burner cap 140 and the mixed gas guide hole 139 of the burner head 130. The mixed gas passing through the mixed gas guide hole 139 may be ignited by the ignition part 160.

The flame formed by the ignition part 160 is spread along the first slits 144, and then spread along each of the plurality of mixed gas discharging holes 142. Therefore, the flame may be generated upward at the burner cap 140.

According to the embodiment, structures of the burner head and the burner cap may be simplified, and non-uniformity of the flame generated when the burner cap is erroneously seated on the burner head may be prevented.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or comprises or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A gas burner comprising:

a frame having an upper plate;

a burner head provided on the upper plate, the burner head having a mixed gas flowing part and a mixed gas chamber in which a mixed gas is received;

a burner cap provided on the burner head; and a burner body at which a nozzle to inject a gas to the burner head is provided, wherein the nozzle is disposed outside of the frame, wherein the mixed gas flowing part is provided at a lower surface of the burner head and extends radially from a center portion of the burner head, wherein the nozzle is spaced horizontally apart from the center portion of the burner head, wherein the nozzle is spaced horizontally apart from the mixed gas flowing part, such that the gas injected from the nozzle horizontally flows to the mixed gas flowing part, wherein the burner cap comprises a plurality of mixed gas discharging holes for generating a flame, wherein the burner head includes a guide part which guides the mixed gas flowing through the mixed gas flowing part upward, the guide part protrudes upward from a bottom wall forming the mixed gas chamber, and wherein the burner cap overlaps the bottom wall and the nozzle, and the bottom wall overlaps the nozzle in a vertical direction.

2. The gas burner of claim 1, wherein the burner body comprises:

a nozzle installation part at which the nozzle is provided, wherein a portion of the burner body is provided within the frame, and wherein the nozzle installation part passes through an opening in the upper plate and is disposed outside of the frame.

3. The gas burner of claim 2, wherein a portion of the burner body blocks the opening.

4. The gas burner of claim 1, wherein the upper plate comprises at least one supporting part to support the burner head, and the burner head comprises at least one movement preventing part in contact with the at least one supporting part to prevent the burner head from moving in a horizontal direction.

5. The gas burner of claim 4, wherein the at least one supporting part protrudes upward from the upper plate and has a rounded surface.

6. The gas burner of claim 4, wherein the at least one movement preventing part protrudes downward from a lower surface of the burner head, and has at least two points of contact with each of the at least one supporting part.

7. The gas burner of claim 4, further comprising:

a container supporting part provided on the upper plate to support a container.

8. The gas burner of claim 1, further comprising:

an ignition part to ignite a mixed gas, wherein the burner cap includes a slit to spread the flame to one or more of the plurality of mixed gas discharging holes.

9. The gas burner of claim 8, wherein the burner head comprises a chamber forming wall to form a mixed gas chamber, the chamber forming wall having a mixed gas guide hole through which the mixed gas in the mixed gas chamber is discharged, and the mixed gas discharged from the mixed gas guide hole flows toward the ignition part.

10. The gas burner of claim 8, wherein the ignition part is provided at the burner body.

11. The gas burner of claim 10, wherein the upper plate of the frame comprises a hole through which the ignition part passes.

12. The gas burner of claim 1, further comprising:

a flame detection part to detect whether the flame is generated at one or more of the plurality of mixed gas discharging holes, wherein the burner head comprises a recess in which at least a part of the flame detection part is received.

13. The gas burner of claim 12, wherein the flame detection part is provided at the burner body and passes through the upper plate.

14. The gas burner of claim 12, wherein a slit in which the flame stays is provided at the burner cap, and the slit is disposed between one or more of the plurality of mixed gas discharging holes and the flame detection part.

15. A gas burner comprising:

a frame having an upper plate;

a burner head provided on the upper plate, the burner head having a mixed gas flowing part and a chamber forming wall configured to form a mixed gas chamber;

a burner cap provided on the burner head and having a plurality of mixed gas discharging holes to generate a flame; and a burner body at which a nozzle to inject a gas to the burner head is provided;

an ignition part configured to ignite a mixed gas; and a flame detection part configured to detect whether or not the flame is generated at one or more of the plurality of mixed gas discharging holes, wherein the burner head comprises a recess in which at least a part of the flame detection part is received, wherein the burner cap comprises a receiving recess in which at least a part of the flame detection part is located is provided at the edge of the burner cap and one or more slits provided at a position which is spaced from an inside of the receiving recess to allow the flame to be stayed therein.

16. The gas burner of claim 15, wherein the burner body comprises:

a nozzle installation part at which the nozzle is provided, wherein a portion of the burner body is provided within the frame, and wherein the nozzle installation part passes through an opening in the upper plate and is disposed outside of the frame.

17. The gas burner of claim 15, wherein a portion of the burner body blocks the opening.

18. The gas burner of claim 15, wherein the upper plate comprises at least one supporting part to support the burner head, and the burner head comprises at least one movement preventing part in contact with the at least one supporting part to prevent the burner head from moving in a horizontal direction.

* * * * *